US006622535B2

(12) United States Patent
Chiang et al.

(10) Patent No.: US 6,622,535 B2
(45) Date of Patent: Sep. 23, 2003

(54) LOCK CONSTRUCTION HAVING AN ELECTRICALLY ACTIVATED CLUTCH MECHANISM AND A TRANSMISSION MECHANISM

(75) Inventors: Wei-Lung Chiang, Chiayi (TW); Tsung-Chung Hung, Chiayi (TW); Po-Yang Chen, Chiayi (TW); Chen-Ming Lin, Chiayi (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 4 days.

(21) Appl. No.: 09/976,367

(22) Filed: Oct. 12, 2001

(65) Prior Publication Data

US 2002/0053227 A1 May 9, 2002

(30) Foreign Application Priority Data

Oct. 13, 2000 (TW) ..... 89217831 U
Oct. 18, 2000 (TW) ..... 89218105 U

(51) Int. Cl.[7] ..... E05B 13/00; E05B 63/14

(52) U.S. Cl. ..... 70/107; 70/149; 70/218; 70/277; 70/472; 292/DIG. 27

(58) Field of Search ..... 70/188, 189, 277, 70/107, 149, 422, 472, 218, 222; 292/DIG. 272

(56) References Cited

U.S. PATENT DOCUMENTS

| | | | | | |
|---|---|---|---|---|---|
| 235,983 | A | * | 12/1880 | Batt | |
| 1,066,465 | A | * | 7/1913 | Carroll | |
| 3,390,558 | A | * | 7/1968 | Tornoe et al. | |
| 3,769,822 | A | * | 11/1973 | Yulkowski | 70/107 |
| 3,990,277 | A | * | 11/1976 | Mullich | 70/107 |
| 4,995,248 | A | * | 2/1991 | Liu | 70/107 |
| 5,953,942 | A | * | 9/1999 | Doucet et al. | 70/283 |
| 6,145,353 | A | * | 11/2000 | Doucet | 70/277 |
| 6,354,121 | B1 | * | 3/2002 | Frolov | 70/277 |

FOREIGN PATENT DOCUMENTS

| | | | | |
|---|---|---|---|---|
| DE | 3032086 | * | 3/1982 | 70/277 |
| JP | 223277 | * | 9/1989 | 70/277 |

* cited by examiner

*Primary Examiner*—Lloyd A. Gall

(57) ABSTRACT

This invention is related to a lock construction comprising: an active driving mechanism, a clutch mechanism, a first latch, a first latch-driving member, a second latch, a second latch-driving member, a latch spring, a transmission mechanism, and a handle mechanism. In one embodiment, the lock construction comprises a clutch mechanism that can be activated electrically to allow latching or unlatching of the door. In an alternative embodiment, the lock construction comprises a transmission mechanism that can drive two latches of the lock simultaneously to latch or unlatch the door.

18 Claims, 9 Drawing Sheets

LOCK CONSTRUCTION HAVING AN ELECTRICALLY ACTIVATED CLUTCH MECHANISM AND A TRANSMISSION MECHANISM

FIELD OF INVENTION

This invention provides a lock construction comprising: an active driving mechanism, a clutch mechanism, a first latch, a first latch-driving member, a second latch, a second latch-driving member, a latch spring, a transmission mechanism, and a handle mechanism. The handle mechanism includes a handle, a case, a coil spring, a retaining plate, a clip, and a coverlid. As such, the lock construction is of a simple construction, such that the lock can be mass-produced, and that the handle mechanism can be easily adjusted to a left- or a right-swing door.

BACKGROUND OF INVENTION

This invention is related to a lock construction, in particular to one that is of a simple structure, that can be mass produced, and that having a handle mechanism can be easily adjusted to be applied to a left- or a right-swing door.

SUMMARY OF INVENTION

The conventionally locks, particularly electronic locks, are mostly of very complicated constructions, such that they cannot be easily assembled, and cause difficulty in mass production.

It is thus of a primary object of this invention to provide a lock construction to be used with a lock construction, that is of a simple construction and that can be easily assembled.

It is another object of this invention to provide a handle mechanism which orientation can be easily modified.

In one embodiment, the lock construction comprises a clutch mechanism that can be activated electrically to allow latching or unlatching of the door.

In an alternative embodiment, the lock construction comprises a transmission mechanism that can drive two latches of the lock simultaneously to unlatch the door.

In a further embodiment, an electronic lock is provided, the electronic lock comprising: an active driving mechanism, a clutch mechanism, a first latch, a first latch-driving member, a second latch, a second latch-driving member, a latch spring, a transmission mechanism, and a handle mechanism. The active driving mechanism includes a coil, a coil rod, and a coil rod spring. The clutch mechanism includes a retaining block, a retaining member, and a retaining spring. The transmission mechanism includes a first rotary member, a second rotary member, and a third rotary member. The first rotary member includes a dial and a first aperture for receiving the retaining member of the clutch mechanism. The second rotary member and the third rotary member each include a first flank and a second flank. The first latch-driving member includes a first dial, a second dial, and a third dial. The first latch includes a dial, which, upon being activated in an unlatching direction by the first dial of the first latch-driving member, is retracted to a retracted position or extended to an extended position. The second latch includes a dial, and is partially extended outwards to assume an extended position under the resilience of the latch spring. The second latch-driving member includes a dial, a second aperture, and a handle opening. The dial of the second latch-driving member activates the dial of the second latch subjecting the second latch to the retracted position. The handle mechanism includes a pivotal shaft that couples to the handle opening of the second latch-driving member through a spindle to drive rotation of the second latch-driving member.

When the coil is not activated electrically, the coil rod is supported by resilience of the coil rod spring to assume a non-activated, disengaging position, where the retaining member is supported by resilience of the retaining spring and disengages from the second latch-driving member, such that the first rotary member is not interacted with the second latch-driving member.

When the coil is activated electrically, the coil rod is advanced to an engaging position allowing the second latch-driving member to drive rotation of the first latch-driving member through the transmission mechanism, so as to selectively latch or unlatch the first latch according to one's need.

The handle mechanism further comprises: a handle, a case, a coil spring, a retaining plate, a clip, and a coverlid. The handle includes a pivotal shaft passing through a central hole having an inner ring provided on the case. The coil spring engages around the inner ring of the case. The retaining plate is formed with a slit on a surface thereof, which slit engages to a holding portion provided on the pivotal shaft of the handle. The clip clips to a clip groove formed on the pivotal shaft of the handle. The coil spring is provided on opposing ends thereof with bending portions extending radially outwards, to be driven by bending tabs formed on outer edges of the retaining plate. The coverlid includes a central opening and engages to the case. The coverlid is provided at an edge thereof with at least one recess for engaging a projection on the case. The coverlid is further provided with support posts for supporting the bending portions of the coil spring, such that the handle is capable of recovering to its original position after being free from influences of external forces. When the handle is to be converted into one for use with a left- or a right-swing door, the coverlid may be removed such that relevant parts can be adjusted to a first or a second orientation.

BRIEF DESCRIPTION OF DRAWINGS

The structures and characteristics of this invention can be realized by referring to the appended drawings and explanations of the preferred embodiments.

DETAILED DESCRIPTIONS OF EMBODIMENTS

Figure 1A:
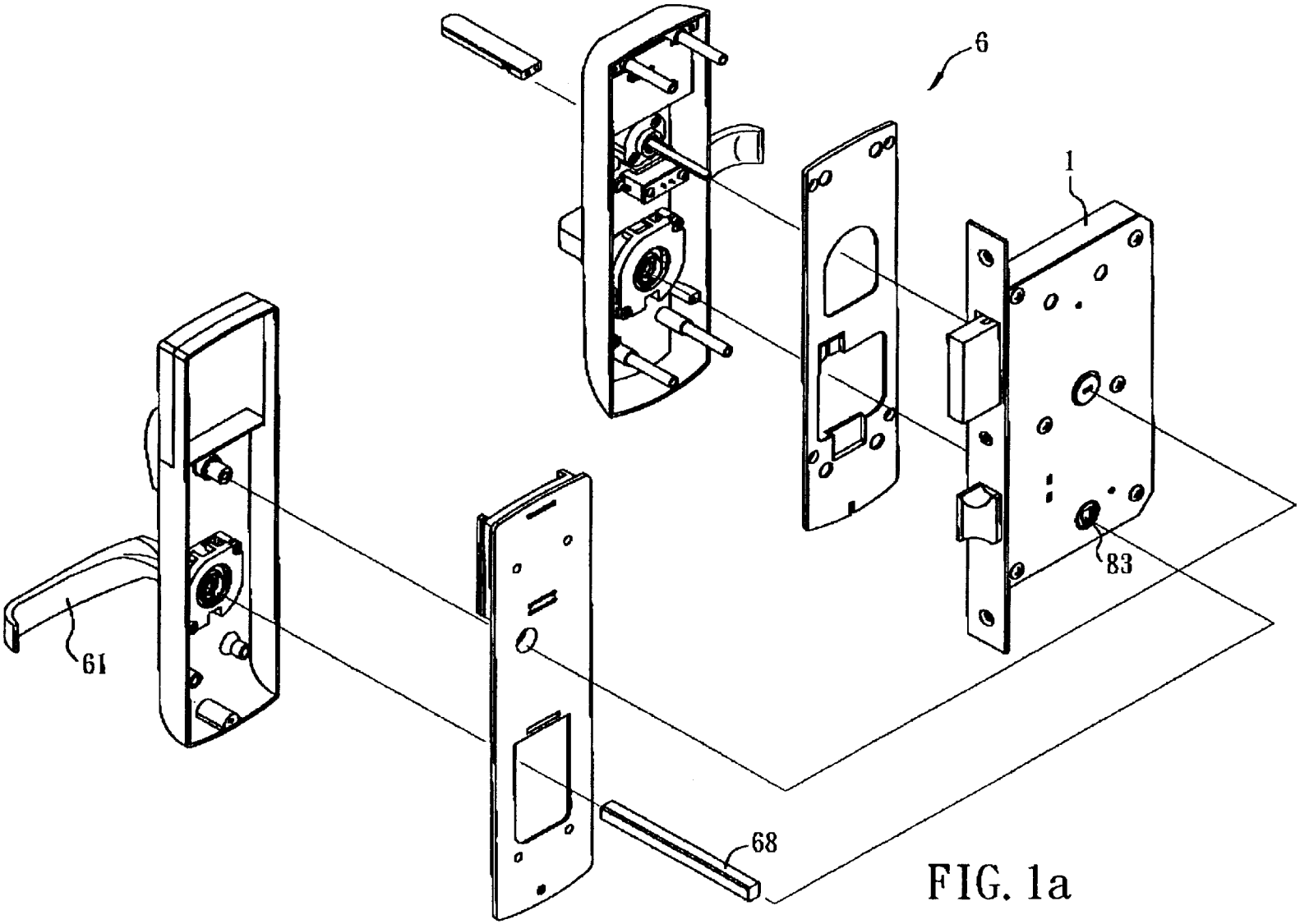
FIG. 1*a* is an illustrative view showing a preferred embodiment embodying the lock construction of this invention.
Figure 1B:
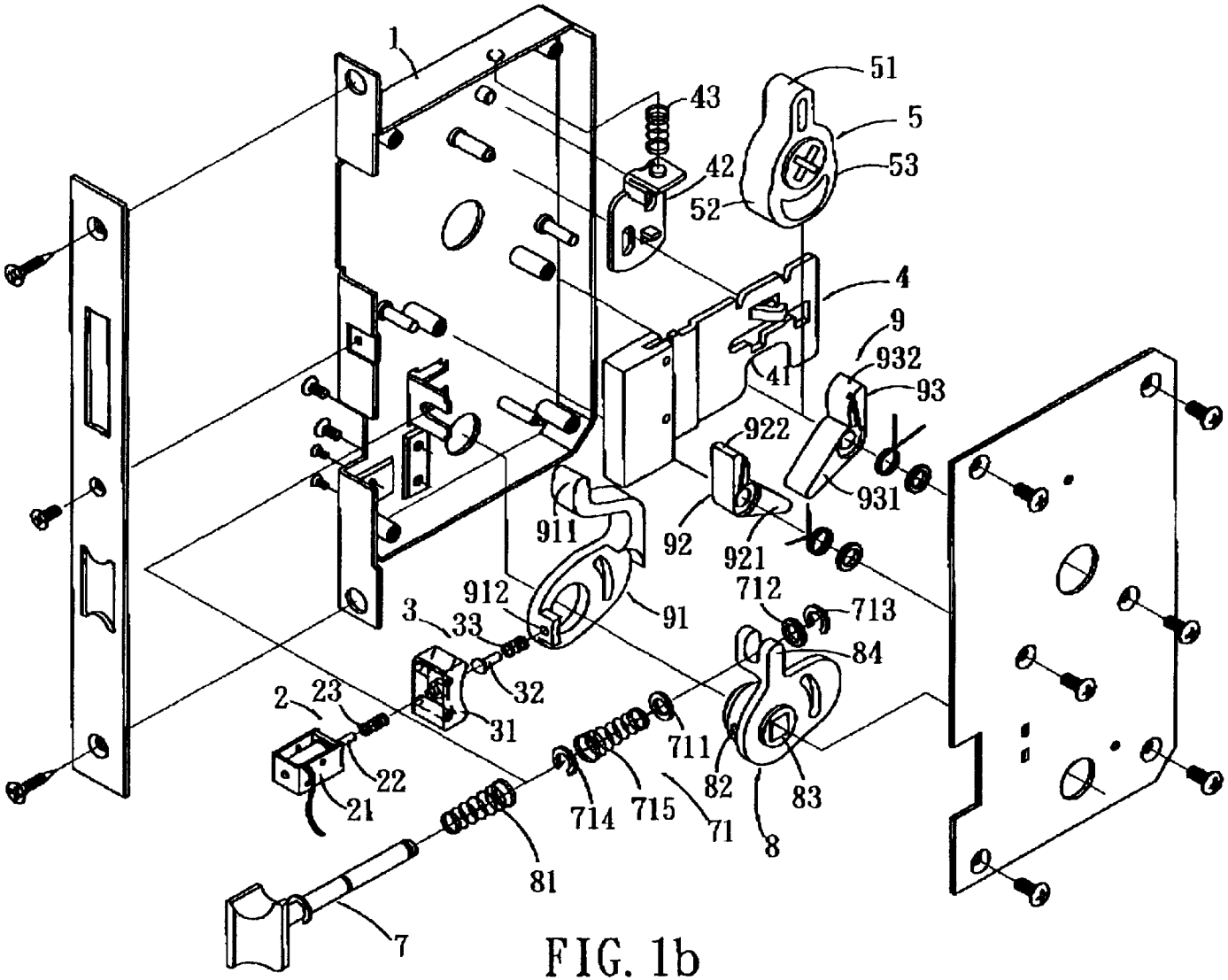
FIG. 1*b* is an illustrative view showing the details of an electronic latch used in this invention

FIG. 1*a* illustrates the exploded, perspective view of the preferred embodiment embodying the lock construction of this invention. FIG. 1*b* is an illustrative view showing the details of an electronic latch used in this invention. As shown in FIGS. 1*a* and 1*b*, the lock construction of this invention comprises: a housing 1, an active driving mechanism 2, a clutch mechanism 3 to be activated by the active driving mechanism 2, a first latch 4, a stopping member 42 retaining the first latch 4 in a retracted or an extended position, a first latch-driving member 5 driving the first latch 4 and the stopping member 42, a second latch 7, a second latch-driving member 8 driving the second latch 7, a latch spring 81 normally urging the second latch 7 to an extended position and co-acting between the second latch 7 and the second latch-driving member 8, a transmission mechanism 9 to be activated by the second latch-driving member 8 to drive the first latch-driving member 5, and a handle mechanism 6 co-acting with the second latch-driving member 8, where details of the handle mechanism 6 are illustrated in FIGS. 8 to 14 and will be described later.

The active driving mechanism 2 includes: a coil 21, a coil rod 22 extending from the coil 21, and a coil rod spring 23 engaging over the coil rod 22.

The clutch mechanism 3 includes: a retaining block 31, a retaining member 32 normally engaging the retaining block 31, and a retaining spring 33 engaging over the retaining member 32.

The transmission mechanism 9 includes: a first rotary member 91, a spring-loaded second rotary member 92, and a spring-loaded third rotary member 93. The first rotary member 91 includes a dial 911 and a first aperture 912 for receiving the retaining member 32 of the clutch mechanism 3. The second rotary member 92 includes a first flank 921 and a second flank 922; the third rotary member 93 includes a first flank 931 and a second flank 932. The dial 911 of the first rotary member 91 may be selectively activated to drive rotation of the second and third rotary members 92, 93.

The first latch-driving member 5 includes a first dial 51, a second dial 52, and a third dial 53. The second dial 52 is to be activated by the second rotary member 92, and the third dial 53 is to be activated by the third rotary member 93.

The stopping member 42 includes a compression spring 43, and is capable of displacement to urge against the compression spring 43 upon being activated by the first dial 51 of the first latch-driving member 5.

Figure 2:
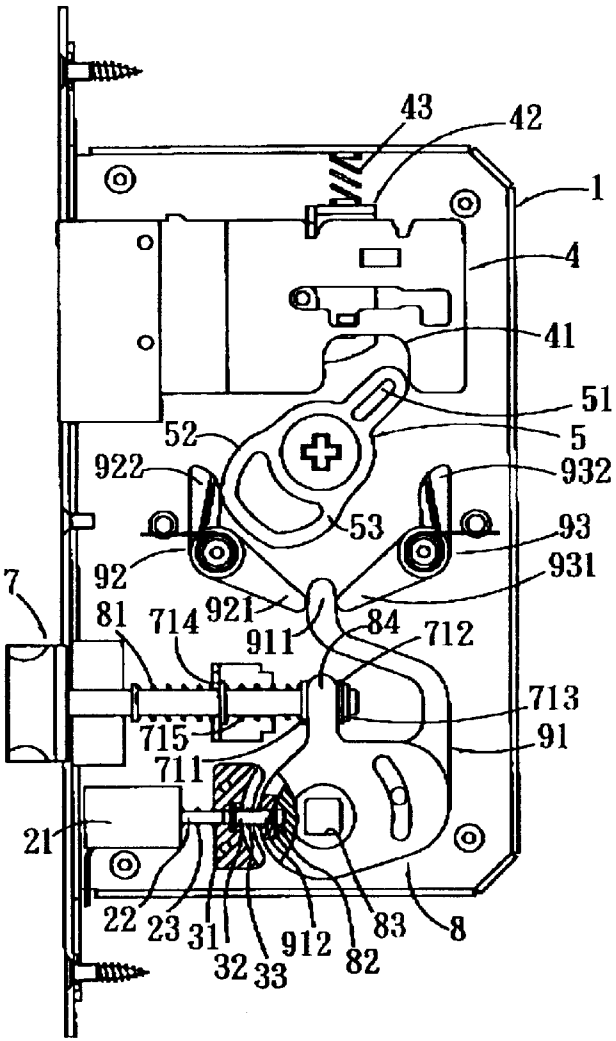
FIG. 2 is a partially cross-sectional view showing the active driving mechanism of preferred embodiment that has not been activated electrically and showing state of the latch being unlatched.
Figure 5:
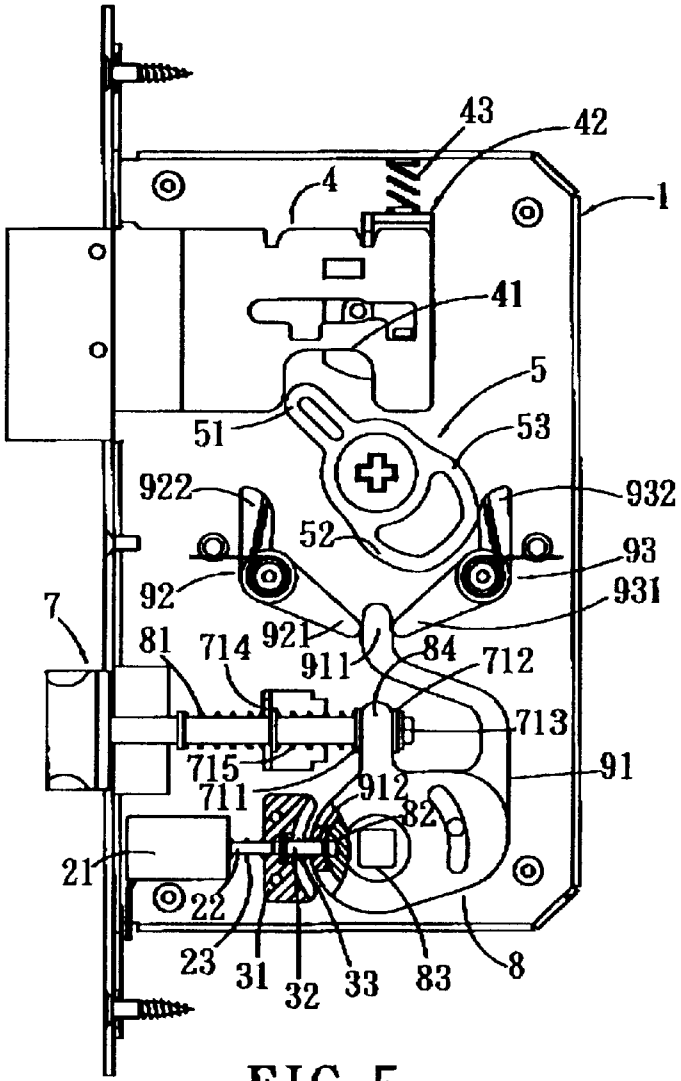
FIG. 5 is a partially cross-sectional view showing that the first latch of the preferred embodiment under the state of being latched.
Figure 4:
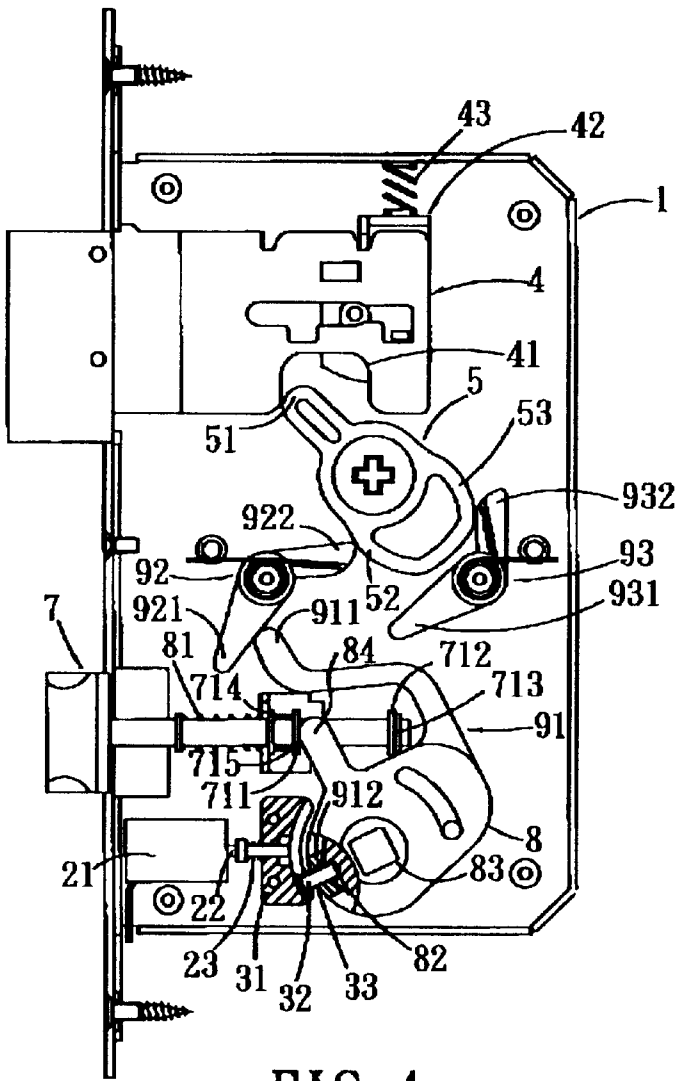
FIG. 4 is a partially cross-sectional view showing that the first latch of the preferred embodiment to extend.
Figure 7:
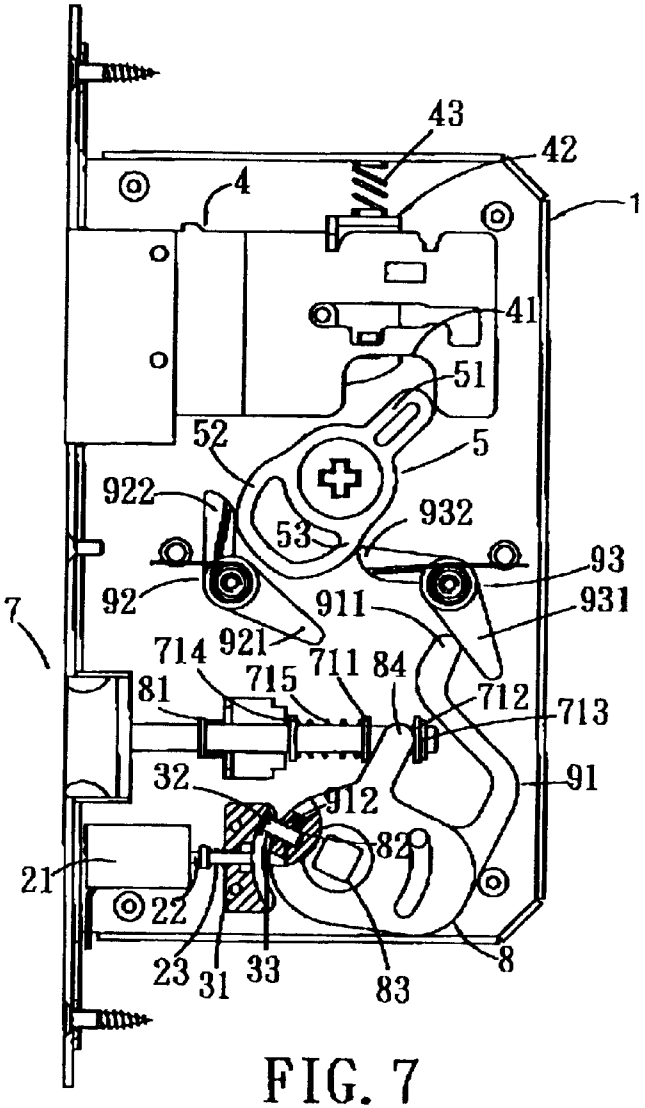
FIG. 7 is a partially cross-sectional view showing that the first latch of the preferred embodiment to retract.

The first latch 4 is movable between a latching direction and an unlatching direction opposing the latching direction. The first latch 4 includes a dial 41 (configured to an inversed-U in this embodiment), which, upon being activated in the unlatching direction by the first dial 51 of the first latch-driving member 5, is retracted and retained in a retracted position by the stopping member 42 as illustrated in FIGS. 2 and 7, or upon being activated in the latching direction by the first dial 51 of the first latch-driving member 5, is extended and retained in an extended position by the stopping member 42 as illustrated in FIGS. 4 and 5.

The second latch 7 is movable between the latching direction and the unlatching direction. The second latch 7 includes a dial 71 that, in this embodiment, comprises: a spring 715 and gaskets 711, 712 engaging over and retained to the second latch 7 by C-clips 714, 713. The second latch 7 is partially extended towards the latching direction to assume an extended position of FIG. 2 under the resilience of the latch spring 81.

The second latch-driving member 8 includes: a dial 84, a second aperture 82 for selectively receiving the retaining member 32 so as to engage with the first rotary member 91, and a handle opening 83. The dial 84 of the second latch-driving member 8 is retained between the gaskets 711 and 712 of the dial 71 of the second latch 7, such that the second latch 7 is retracted to the retracted position of FIG. 7 and urges against the latch spring 81 when the dial 84 of the second latch-driving member 8 activates the dial 71 of the second latch 7.

The handle mechanism 6 includes a pivotal shaft 611 (FIG. 8) that is formed with an opening 614; a spindle 68 connects the handle mechanism 6 to the second latch-driving member 8 by coupling between the opening 614 and the handle opening 83 of the second latch-driving member 8, for selectively driving rotation of or being driven by the second latch-driving member 8. In FIGS. 2–7, the position of the handle mechanism 6 can be inferred by the position of the second latch-driving member 8 and FIGS. 2 and 5 illustrates a level position of the handle mechanism 6.

As illustrated in FIG. 2, when the coil 21 is not activated electrically, the coil rod 22 is supported by resilience of the coil rod spring 23 to assume a non-activated, disengaging position. In this disengaging position, the retaining member 32 is supported by resilience of the retaining spring 33 and disengages from the second latch-driving member 8, such that the first rotary member 91 disengages from the second latch-driving member 8. Under this disengaging position, the handle mechanism 6 can freely drive the second latch-driving member 8 to move in the unlatching direction for unlatching the second latch 7, without activating the first rotary member 91.

Figure 3:
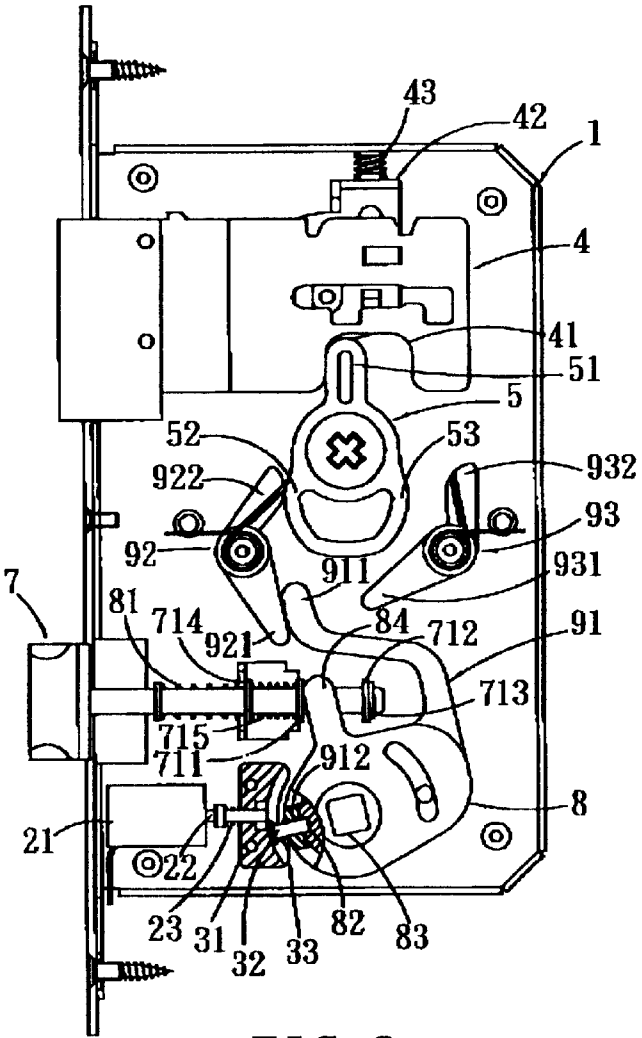
FIG. 3 is a partially cross-sectional view showing that the active driving mechanism of the preferred embodiment upon being activated electrically.

In order to latch the first latch 4, as illustrated in FIGS. 3 and 4, the coil 21 is activated electrically to advance the coil rod 22 to an engaging position. In this engaging position, part of the retaining member 32 that is originally received in the first aperture 912 advances to engage the second aperture 82 of the second latch-driving member 8. Under such an engaging position, when the second latch-driving member 8 is rotated towards the latching direction by the handle mechanism 6, the first rotary member 91 is driven to rotate at the same time due to engagement between the second latch-driving member 8 and the first rotary member 91 via the retaining member 32.

Along with rotation of the first rotary member 91, the dial 911 of the first rotary member 91 activates the first flank 921 of the second rotary member 92 to drive rotation of the second rotary member 92; then, the second flank 922 of the second rotary member 92 activates the second dial 52 of the first latch-driving member 5 to drive rotation of the first latch-driving member 5. As such, the stopping member 42 is displaced to urge against the compression spring 43 by the first dial 51 of the first latch-driving member 5, as illustrated in FIG. 3.

Under this state, the first latch 4 is free from restraint such that the first latch 4 can be activated by the first dial 51 of the first latch-driving member 5 to move towards the latching direction, and to freely extend to the extended position from the retracted position. Once the first latch 4 reaches the extended position, the compression spring 43 urges the stopping member 42 to displace so as to retain the first latch 4 in the extended position. By releasing the handle mechanism 6 at this time, the second latch-driving member 8 subjects the handle mechanism 6 to recover to its original position under influences of recovering force of the spring 715, the retaining spring 33 subjects the retaining member 32 to recover to the disengaging position, and the spring-loaded second rotary member 92 returns to its original position, as shown in FIG. 5.

Figure 6:
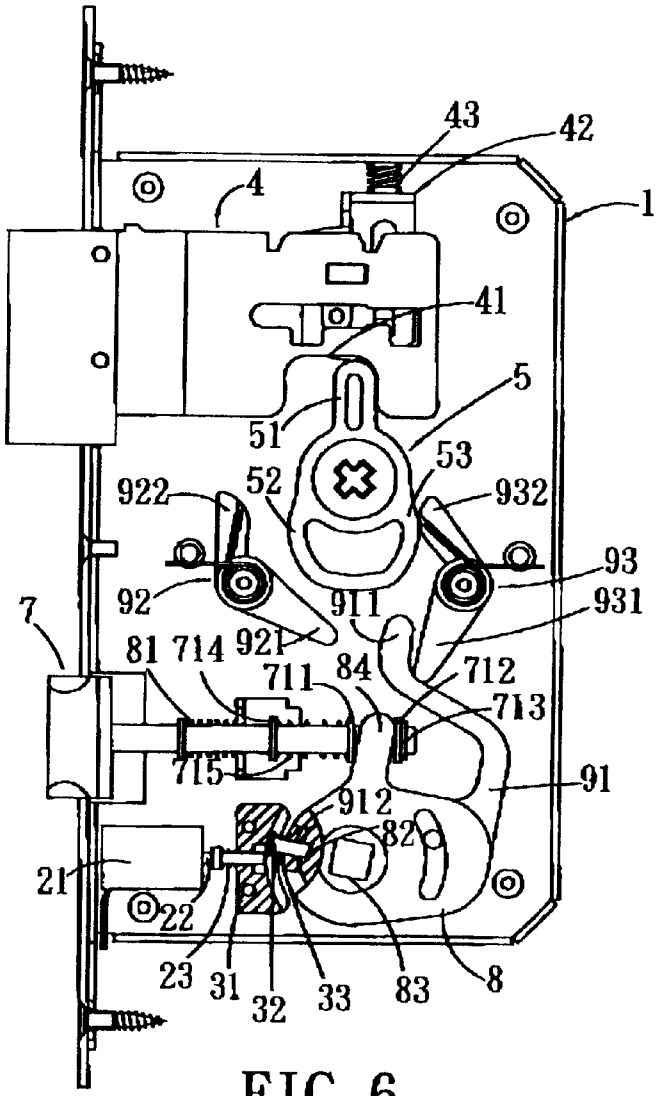
FIG. 6 is a partially cross-sectional view showing that the active driving mechanism of the preferred embodiment upon being activated electrically.
Figure 8:
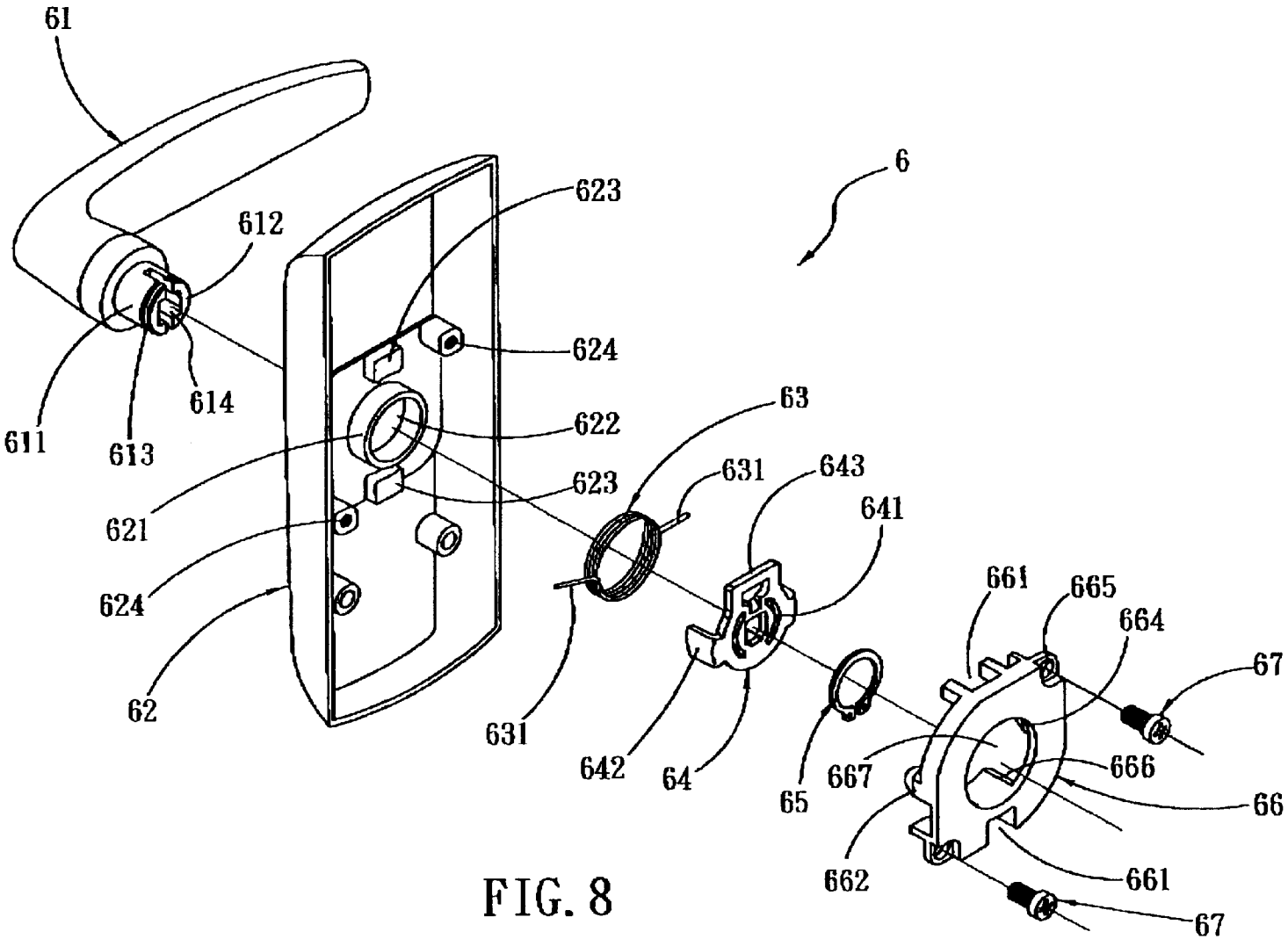
FIG. 8 is an exploded, perspective view of a handle mechanism of the preferred embodiment.

To unlatch the first latch 4, as shown in FIGS. 6 and 7, the coil 21 is activated electrically to advance the coil rod 22 to the engaging position. Under the engaging position as described previously, when the second latch-driving member 8 is rotated towards the unlatching direction through the handle mechanism 6, the first rotary member 91 is driven to rotate at the same time due to engagement between the second latch-driving member 8 and the first rotary member 91 via the retaining member 32.

Along with rotation of the first rotary member 91, the dial 911 of the first rotary member 91 activates the first flank 931 of the third rotary member 93 to drive rotation of the third rotary member 93; then the second flank 932 of the third rotary member 93 activates the third dial 53 of the first latch-driving member 5 to drive rotation of the first latch-driving member 5. As such, the stopping member 42 is displaced to urge against the compression spring 43 by the first dial 51 of the first latch-driving member 5, as illustrated in FIG. 6.

Under this state, the first latch 4 is free from restraint such that the first latch 4 can be activated by the first dial 51 of the first latch-driving member 5 to move towards the unlatching direction, and to freely retract into the retracted position from the extended position. At the same time, the dial 84 of the second latch-driving member 8 activates the second latch 7, so as to retract the second latch 7 to the retracted position, thereby unlatching the door. Once the first latch 4 reaches the retracted position, the compression spring 43 urges the stopping member 42 to displace so as to retain the first latch 4 in the retracted position. By releasing the handle mechanism 6 at this time, the second latch-driving member 8 subjects the handle mechanism 6 to recover to its original position under influences of recovering force of the latch spring 81, the retaining spring 33 subjects the retaining member 32 to recover to the disengaging position, and the spring-loaded third rotary member 93 returns to its original position, to the state of FIG. 2.

FIGS. 8 to 14 illustrate a handle mechanism 6 that maybe implemented in the electronic latch as described above. The handle mechanism 6 comprises: a handle 61, a case 62, a coil spring 63, a retaining plate 64, a clip 65, and a coverlid 66. The pivotal shaft 611 of the handle mechanism 6 passes through a central hole 622 having an inner ring 621 provided on the case 62, and is coupled to the handle opening 83 of the second latch-driving member 8 through a spindle 68, as shown in FIG. 1*a*.

The coil spring 63 engages around the inner ring 621 of the case 62. The retaining plate 64 is formed with a slit 641 on a surface thereof, which slit 641 engages to a holding portion 612 provided on the pivotal shaft 611 of the handle 61. The case 62, the coil spring 63, and the retaining plate 64 are placed between the handle 61 and the clip 65, which clips to a clip groove 613 formed on the pivotal shaft 611 of the handle 61, so as to allow the coil spring 63 and the retaining plate 64 to rotate along with the handle 61.

The case 62 is formed with two projections 623 at predetermined locations of a face facing the coil spring 63. The coil spring 63 is provided on opposing ends thereof with bending portions 631 extending radially outwards. The retaining plate 64 is formed on an outer edge thereof with an extension 643 and bending tabs 642 normal to a plane containing the retaining plate 64.

One of the bending portions 631 of the coil spring 63 is driven by the bending tab 642 of the retaining plate 64. The case 62 is formed with supporting screw holes 624 at predetermined locations of the face facing the coil spring 63. The coverlid 66 includes a central opening 667 and an aperture 665, through which central opening 667 the pivotal shaft 611 of the handle 61 passes. The coverlid 66 is joined to the case 62 by passing a screw 67 through the aperture 665 of the coverlid 66.

The coverlid 66 is provided at an edge thereof with at least one recess 661, symmetrical first limiting faces 664, symmetrical second limiting faces 666, and support posts 662 normal to a plane containing the coverlid 66. The recess 661 engages a projection 623 on the case 62. The support posts 662 support the bending portions 631 of the coil spring 63. The bending tabs 642 are each placed between the first and the second limiting face 664, 666. The extension 643 of the retaining plate 64 is placed between the first limiting faces 664.

The support posts 662 of the coverlid 66 support the bending portion 631 of the coil spring 63, such that the handle is capable of recovering to its original position after being free from influences of external forces. When the handle 61 is to be converted into one for use with a left- or a right-swing door, the coverlid 66 may be removed such that the coverlid 66 and the handle 61 can be adjusted to a first or a second orientation, as described hereinafter.

Figure 10:
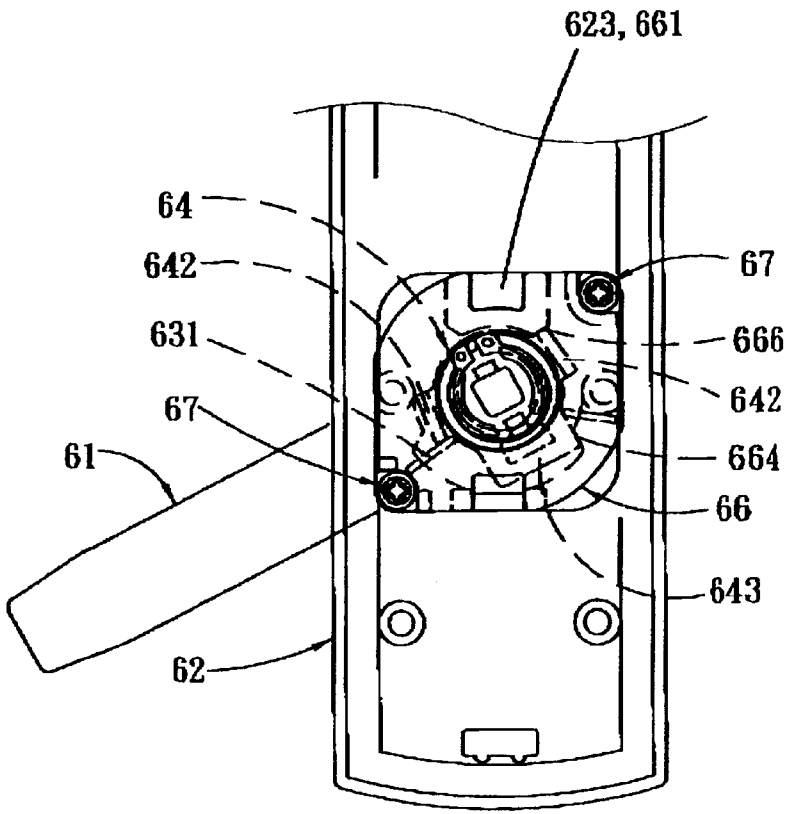
FIG. 10 is an assembled, elevational view showing the handle in FIG. 9 being rotated from a level position under influences of external forces.
Figure 9:
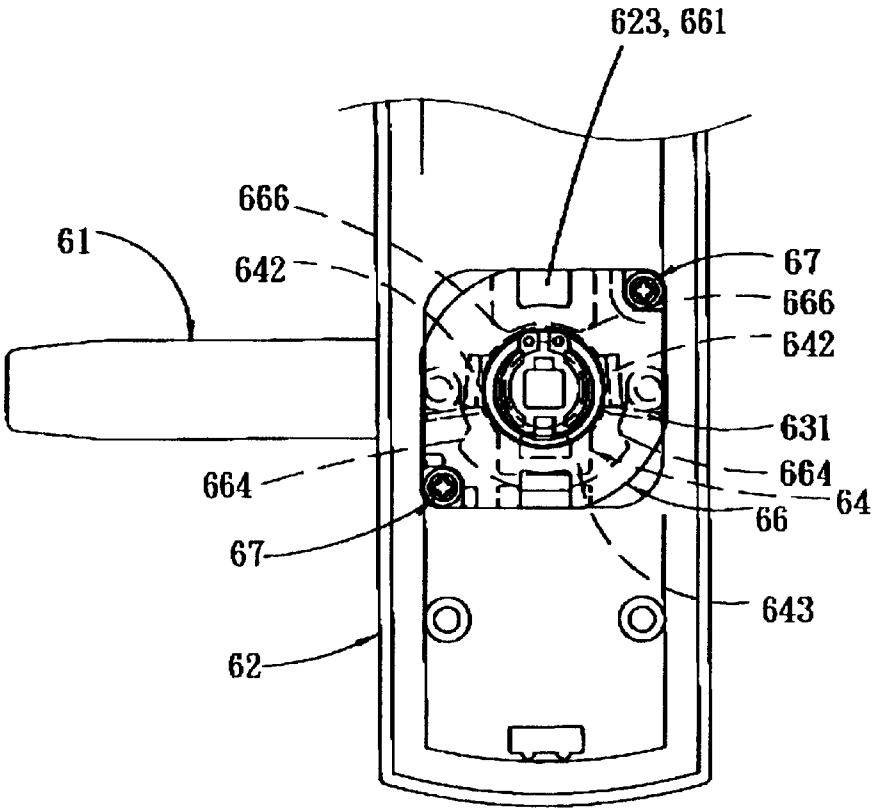
FIG. 9 is an assembled, elevational view showing a handle mechanism of the preferred embodiment being applied to a left-swing door.
Figure 12:
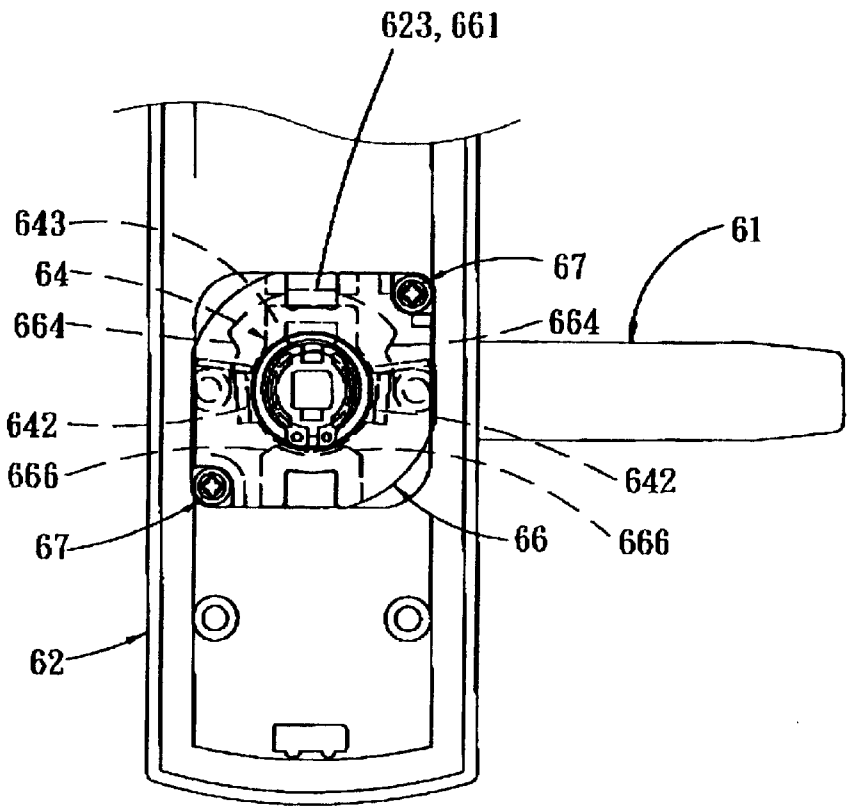
FIG. 12 is an assembled, elevational view showing a handle mechanism of the preferred embodiment being applied to a right-swing door.

FIG. 9 is an assembled, elevational view showing the handle mechanism 6 being applied to a left-swing door, where the coverlid 66 and the handle 61 are at the first orientation. As shown in FIG. 10, when the handle 61 is operated by an external force, the retaining plate 64 rotates for an angle until the extension 643 of the retaining plate 64 comes into contact with the first limiting face 664 of the coverlid 66 and the bending tab 642 of the retaining plate 64 comes into contact with the second limiting face 666 of the coverlid 66, for retraining the range that the retaining plate 64 may rotate. At the same time, another bending tab 642 of the retaining plate 64 biases against the bending portion 631 of the coil spring 63, such that the handle is capable of recovering to its original position after being free from influences of external forces due to biasing force of the coil spring 63.

Figure 11:
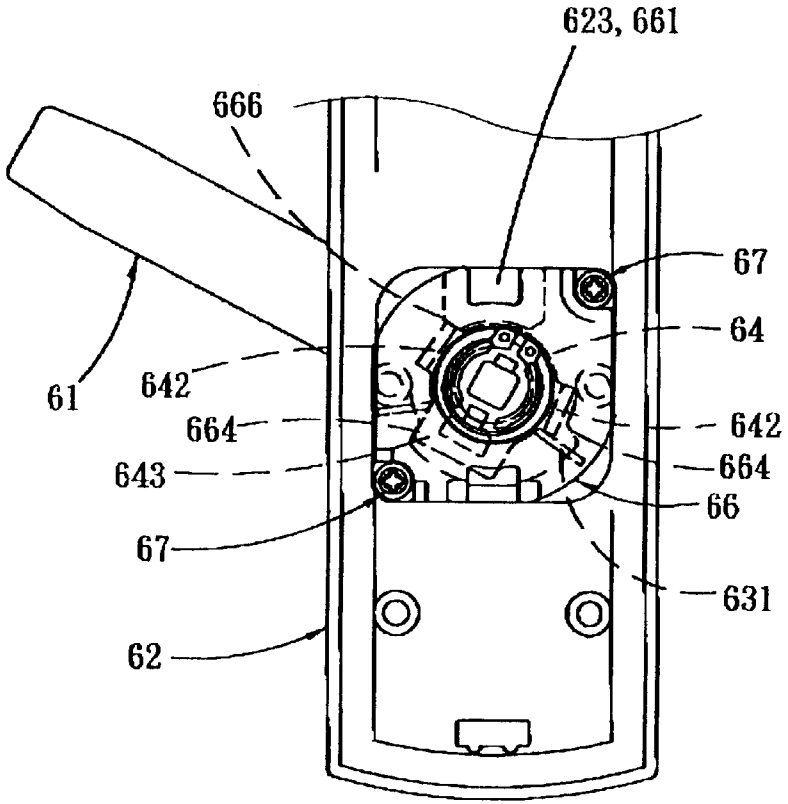
FIG. 11 is an assembled, elevational view showing the handle in FIG. 9 being rotated from a level position under influences of external forces.

As illustrated in FIG. 11, the above operation applies when the handle 61 is operated in an opposing direction by an external force.

To convert the handle mechanism 6 for use with a right-swing door, the screws 67 and the coverlid 66 are first removed. Parts including the coil spring 63, retaining plate 64, clip 65, coverlid 66, and handle 611 are rotated for 180°, to place these parts in the second orientation. The screws 67 are then passed through the apertures 665 of the coverlid 66 to lock the coverlid 66 to the supporting screw holes 624.

Figure 13:
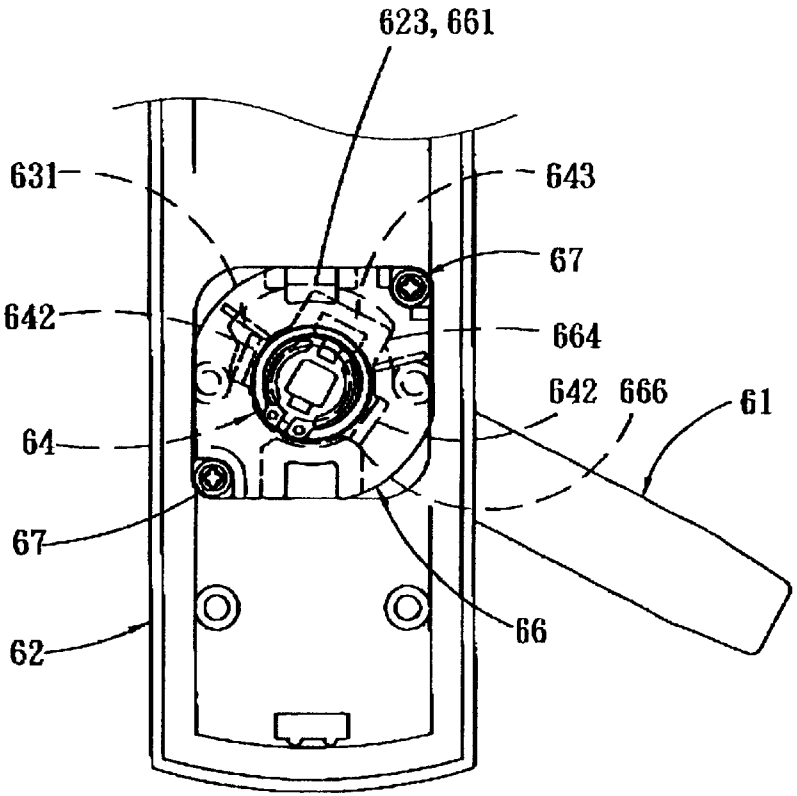
FIG. 13 is an assembled, elevational view showing the handle in FIG. 12 being rotated from a level position under influences of external forces.

As shown in FIG. 13, when the handle 61 is operated by an external force, the retaining plate 64 rotates for an angle until the extension 643 of the retaining plate 64 comes into contact with the first limiting face 664 of the coverlid 66 and the bending tab 642 of the retaining plate 64 comes into contact with the second limiting face 666 of the coverlid 66, for retraining the range that the retaining plate 64 may rotate. At the same time, another bending tab 642 of the retaining plate 64 biases against the bending portion 631 of the coil spring 63, such that the handle is capable of recovering to its original position after being free from influences of external forces due to biasing force of the coil spring 63.

Figure 14:
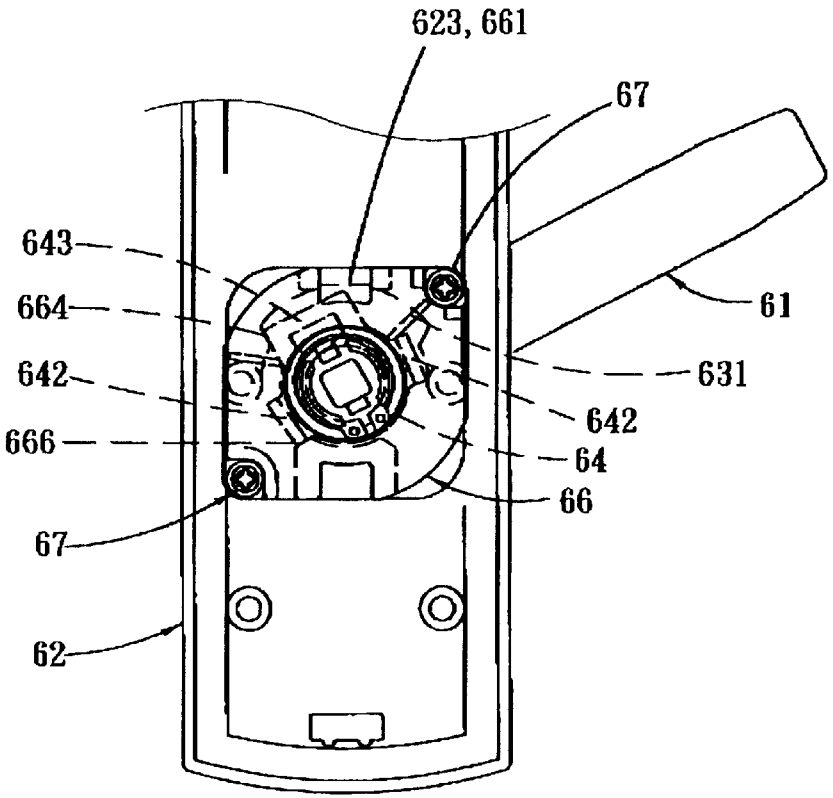
FIG. 14 is an assembled, elevational view showing the handle in FIG. 12 being rotated from a level position under influences of external forces.

As illustrated in FIG. 14 the above operation applies when the handle 61 is operated in an opposing direction by an external force.

This invention is related to a novel creation that makes a breakthrough to conventional art. Aforementioned explanations, however, are directed to the description of preferred embodiments according to this invention. Various changes and implementations can be made by those skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. A lock construction, comprising:

an active driving mechanism, including: a coil, a coil rod extending from the coil, and a coil rod spring engaging over the coil rod normally maintaining the coil rod in a disengaging position;

a first latch movable between a retracted and an extended position;

a first latch-driving member adapted to drive the first latch to move between its retracted and extended position;

a second latch movable between a retracted and an extended position;

a second latch-driving member driving the second latch to move to its retracted position;

a latch spring normally urging the second latch in the extended position and co-acting between the second latch and the second latch-driving member;

a transmission mechanism selectively activated by the second latch-driving member to drive the first latch-driving member;

a clutch mechanism selectively activated by the active driving mechanism so as to engage the second latch-driving member with the transmission mechanism; and whereby the clutch mechanism normally disengages the second latch-driving member, when the coil rod of the active driving mechanism is activated electrically, the coil rod of the active driving mechanism activates the clutch mechanism to engage the second latch-driving member with the transmission mechanism so that the second latch-driving member activates the first latch-driving member through the transmission mechanism.

2. The lock construction of claim 1, wherein:

the clutch mechanism includes: a retaining block, a retaining member normally engaging the retaining block, and a retaining spring engaging over the retaining member;

the transmission mechanism is formed with a first aperture for receiving the retaining member of the clutch mechanism;

the second latch-driving member is formed with a second aperture for selectively receiving the retaining member;

whereby when the coil rod of the active driving mechanism is activated electrically, the coil rod of the active driving mechanism drives the retaining member to enter the second aperture of the second latch-driving member, so as to engage the second latch-driving member with the transmission mechanism.

3. The lock construction of claim 2, wherein the transmission mechanism further includes:

a first rotary member having a dial and being formed with the first aperture for receiving the retaining member of the clutch mechanism;

a spring-loaded second rotary member having a first flank and a second flank; and a spring-loaded third rotary member having a first flank and a second flank, wherein the dial of the first rotary member is selectively activated to drive the first flank of the second rotary member or the first flank of the third rotary member.

4. The lock construction of claim 3, wherein the first latch-driving member includes:

a first dial, a second dial, and a third dial, the second dial being activated by the second flank of the second rotary member, and the third dial being activated by the second flank of the third rotary member.

5. The lock construction of claim 4, wherein the first latch includes: a dial to be activated by the first dial of the first latch-driving member to move the first latch between its retracted and extended position.

6. The lock construction of claim 5, where the second latch-driving member further includes: a dial and a handle opening for receiving a handle mechanism.

7. The lock construction of claim 6, wherein the second latch comprises: a spring and two gaskets engaging over and retained to the second latch, the spring being adjacent to the dial of the second latch-driving member, and the dial of the second latch-driving member being retained between the gaskets.

8. The lock construction of claim 7, wherein the handle mechanism is formed with an opening, and includes a spindle connecting the handle mechanism to the second latch-driving member by coupling between the opening and the handle opening of the second latch-driving member.

9. A lock construction, comprising:

a first latch movable between a retracted and an extended position;

a first latch-driving member adapted to drive the first latch to move between its retracted and extended position, wherein the first latch-driving member includes a first dial, a second dial, and a third dial;

a second latch movable between a retracted and an extended position;

a second latch-driving member driving the second latch to move to its retracted position;

a latch spring normally urging the second latch in the extended position and co-acting between the second latch and the second latch-driving member;

a transmission mechanism selectively activated by the second latch-driving member to drive the first latch-driving member, wherein the transmission mechanism includes: a first rotary member having a dial, a spring-loaded second rotary member having a first flank and a second flank, and a spring-loaded third rotary member having a first flank and a second flank, the dial of the first rotary member being selectively activated by the second latch-driving member to drive the first flank of the second rotary member or the first flank of the third rotary member, subjecting the second flank of the second rotary member to activate the second dial of the first latch-driving member or the second flank of the third rotary member to activate the third dial of the first latch-driving member;

a clutch mechanism selectively engaging the second latch-driving member with the first rotary member of the transmission mechanism.

10. The lock construction of claim 9, wherein:

the clutch mechanism includes: a retaining block, a retaining member normally engaging the retaining block, and a retaining spring engaging over the retaining member normally maintaining the clutch mechanism in a disengaging position;

the first rotary member of the transmission mechanism is formed with a first aperture for receiving the retaining member of the clutch mechanism;

the second latch-driving member is formed with a second aperture for selectively receiving the retaining member;

whereby the second latch-driving member engages with the transmission mechanism when the retaining member is driven to enter the second aperture of the second latch-driving member.

11. The lock construction of claim 10, wherein the first latch includes: a dial to be activated by the first dial of the first latch-driving member to move the first latch between its retracted and extended position.

12. The lock construction of claim 11, wherein the second latch-driving member further includes: a dial and a handle opening for receiving a handle mechanism.

13. The lock construction of claim 12, wherein the second latch comprises: a spring and two gaskets engaging over and retained to the second latch, the spring being adjacent to the dial of the second latch-driving member, and the dial of the second latch-driving member being retained between the gaskets.

14. The lock construction of claim 13, wherein the handle mechanism is formed with an opening, and includes a spindle connecting the handle mechanism to the second latch-driving member by coupling between the opening and the handle opening of the second latch-driving member.

15. An electronic lock construction, comprising:

an active driving mechanism, the active driving mechanism including a coil, a coil rod extending from the coil, and a coil rod spring engaging over the coil rod normally maintaining the coil rod in a disengaging position;

a first latch movable between a retracted and an extended position and including a dial;

a first latch-driving member including a first dial, a second dial, and a third dial;

a second latch movable between a retracted and an extended position;

a second latch-driving member being formed with a second aperture and including a dial and a handle opening, the second latch-driving member driving the second latch to move to its retracted position;

a latch spring normally urging the second latch in the extended position and co-acting between the second latch and the second latch-driving member;

a transmission mechanism including: a first rotary member having a dial and being formed with a first aperture a spring-loaded second rotary member having a first flank and a second flank, and a spring-loaded third rotary member having a first flank and a second flank, the dial of the first rotary member being selectively activated to drive the first flank of the second rotary member or the first flank of the third rotary member, such that the second flank of the second rotary member activates the second dial of the first latch-driving member or the second flank of the third rotary member activates the third dial of the first latch-driving member, so as to activate the first dial of the first latch-driving member;

a clutch mechanism including: a retaining block, a retaining member normally engaging the retaining block, and a retaining spring engaging over the retaining member, wherein the retaining member is received in the first aperture of the transmission mechanism;

a handle mechanism co-acting with the second latch-driving member;

whereby when the coil rod of the active driving mechanism is not activated electrically, the transmission mechanism disengages from the second latch-driving member such that the handle mechanism can only drive the second latch to move to its retracted position, and whereby when the coil rod of the active driving mechanism is activated electrically, the coil rod of the active driving mechanism drives the retaining member to enter the second aperture of the second latch-driving member so as to engage the second latch-driving member with the transmission mechanism, such that the handle mechanism can drive the first latch to move between its retracted and extended position and the second latch to move to its retracted position.

16. The lock construction of claim 15, wherein:

the second latch comprises a spring and two gaskets engaging over and retained to the second latch, the spring being adjacent to the dial of the second latch-driving member, and the dial of the second latch-driving member being retained between the gaskets.

17. The lock construction of claim 16, wherein:

the handle mechanism is formed with an opening, and includes a spindle connecting the handle mechanism to the second latch-driving member by coupling between the opening and the handle opening of the second latch-driving member.

18. The lock construction of claim 17, wherein the handle mechanism further comprises:

a handle, including a pivotal shaft having a holding portion and a clip groove formed thereon, the holding portion is formed with the opening thereon;

a case formed with a central hole having an inner ring, through which central hole the pivotal shaft passes;

a coil spring engaging around the inner ring of the case, the coil spring being provided on opposing ends thereof with bending portions extending radially outwards;

a retaining plate, including an extension, a slit formed on a surface thereof, and bending tabs formed on outer edges thereof, the slit engaging to the holding portion of the pivotal shaft of the handle, the bending tabs driving the bending portions of the coil spring;

a clip clipping to the clip groove formed on the pivotal shaft of the handle; and a coverlid engaging to the case.

* * * * *

UNITED STATES PATENT AND TRADEMARK OFFICE

CERTIFICATE OF CORRECTION

PATENT NO. : 6,622,535 B2
APPLICATION NO. : 09/976367
DATED : September 23, 2003
INVENTOR(S) : Wei-Lung Chiang It is certified that error appears in the above-identified patent and that said Letters Patent is hereby corrected as shown below:

On the title page replace with the following:
(73) Assignee: Tong Lung Metal Industry Co., Ltd.

Signed and Sealed this

Fifth Day of December, 2006

JON W. DUDAS
*Director of the United States Patent and Trademark Office*